US009562535B2

(12) United States Patent
Masuta

(10) Patent No.: US 9,562,535 B2
(45) Date of Patent: Feb. 7, 2017

(54) CROSS-FLOW FAN, ELECTRONIC DEVICE INCLUDING CROSS-FLOW FAN, AND IMPELLER USED FOR CROSS-FLOW FAN

(71) Applicant: KYOCERA Document Solutions Inc., Osaka-shi, Osaka (JP)

(72) Inventor: Noriko Masuta, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/033,564

(22) PCT Filed: Sep. 8, 2015

(86) PCT No.: PCT/JP2015/075426
§ 371 (c)(1),
(2) Date: Apr. 29, 2016

(87) PCT Pub. No.: WO2016/067760
PCT Pub. Date: May 6, 2016

(65) Prior Publication Data

US 2016/0341204 A1 Nov. 24, 2016

(30) Foreign Application Priority Data

Oct. 30, 2014 (JP) ..... 2014-221719

(51) Int. Cl.
*F04D 17/04* (2006.01)
*F04D 29/28* (2006.01)
(Continued)

(52) U.S. Cl.
CPC ..... *F04D 17/04* (2013.01); *F04D 29/282* (2013.01); *F04D 29/624* (2013.01); *F04D 29/661* (2013.01)

(58) Field of Classification Search
CPC ..... F04D 29/281; F04D 29/282; F04D 17/04
See application file for complete search history.

(56) References Cited

U.S. PATENT DOCUMENTS 5,094,586 A * 3/1992 Takada ..... F04D 29/663 415/119
2011/0171004 A1* 7/2011 Shiraichi ..... F04D 29/023 415/53.1
2012/0201680 A1* 8/2012 Hall ..... F04D 29/023 416/178

FOREIGN PATENT DOCUMENTS

JP H09242687 A 9/1997
JP 2000064981 A 3/2000
(Continued)

*Primary Examiner* — Gergory Anderson
*Assistant Examiner* — Michael Sehn
(74) *Attorney, Agent, or Firm* — Alleman Hall McCoy Russell & Tuttle LLP

(57) ABSTRACT

A cross-flow fan (10) including a plurality of impellers (11*a* to 11*g*) connected in a direction of a rotation axis, each of the impellers (11*a* to 11*g*) including: a plurality of blades (12*a* to 12*r*); a first connection portion (13) having at least one projection; and a second connection portion (14) having concavities in a larger quantity than the projection, wherein, in a connection between the first connection portion (13) of one of the impellers (11*a* to 11*g*) and the second connection portion (14) of another one of the impellers (11*a* to 11*g*), the projection of the one of the impellers (11*a* to 11*g*) and one part of the concavities of the other one of the impellers (11*a* to 11*g*) are fitted to each other in one fitted state among N (N is an integer not smaller than two) ways of fitted states of having a matched rotation axis.

8 Claims, 5 Drawing Sheets

(51) Int. Cl.
*F04D 29/62* (2006.01)
*F04D 29/66* (2006.01)

(56) References Cited

FOREIGN PATENT DOCUMENTS

| | | | |
|---|---|---|---|
| JP | 2005127208 | A | 5/2005 |
| JP | 2010209849 | A | 9/2010 |

* cited by examiner

CROSS-FLOW FAN, ELECTRONIC DEVICE INCLUDING CROSS-FLOW FAN, AND IMPELLER USED FOR CROSS-FLOW FAN

TECHNICAL FIELD

The present invention relates to a structure of a cross-flow fan.

BACKGROUND ART

Various fans are used for electronic devices for the purpose of providing blast or internal cooling, for example. Among these fans, a cross-flow fan that is cylindrical, long, and thin provides an effect of being capable of providing a large air pressure for a certain blade diameter, and therefore, is widely used for air conditioners, image forming apparatuses, and the like. A cross-flow fan tends to generate a large wind noise when the volume of blast increases. Therefore, various types of cross-flow fans need to be produced according to usage or specification of electronic products.

For example, a technology of configuring a long and thin cross-flow fan by connecting a plurality of relatively short impellers in the direction of a rotation axis has been known as a related technology (see Patent Literature 1, for example).

CITATION LIST

Patent Literature

[PTL 1] Japanese Laid-Open Patent Publication No. 2005-127208

SUMMARY OF THE INVENTION

Problems to be Solved by the Invention

However, producing various types of cross-flow fans according to usage or specification of electronic products increases cost since a special die has to be prepared for each of the various types of cross-flow fans.

Further, in the related technology described above, since impellers are required to be connected one by one by injecting resin therein, the cost increases because of an increase in man-hours for assembly, compared to many other types of fans.

The present invention aims to provide: a cross-flow fan of various types according to usage or specification of electronic products using impellers having the same shape without preparing a special die; an electronic product including the cross-flow fan; and an impeller used for the cross-flow fan.

Solution to the Problems

A cross-flow fan according to one aspect of the present invention includes a plurality of impellers connected in a direction of a rotation axis. Each of the impellers includes a plurality of blades, a first connection portion having at least one projection, and a second connection portion having concavities in a larger quantity than the projection. In the cross-flow fan, in a connection between the first connection portion of one of the impellers and the second connection portion of another one of the impellers, the projection of the one of the impellers and one part of the concavities of the other one of the impellers are fitted to each other in one fitted state among N (N is an integer not smaller than two) ways of fitted states of having a matched rotation axis.

An electronic product according to another aspect of the present invention includes the cross-flow fan described above and a drive portion configured to rotationally drive the cross-flow fan.

An impeller according to another aspect of the present invention is used for a cross-flow fan including a plurality of impellers connected in a direction of a rotation axis. Each of the impellers includes a plurality of blades, a first connection portion having at least one projection, and a second connection portion having concavities in a larger quantity than the projection. In the impeller, the projection of one of the impellers and one part of the concavities of another one of the impellers are fitted to each other in N (N is an integer not smaller than two) ways of having a matched rotation axis, whereby the first connection portion of the one of the impellers and the second connection portion of the other one of the impellers are connected to each other.

Advantageous Effects of the Invention

According to the present invention, it becomes possible to provide: a cross-flow fan of various types using impellers having the same shape without preparing a special die according to usage or specification of electronic products; an electronic product including the cross-flow fan; and an impeller used for the cross-flow fan.

DESCRIPTION OF EMBODIMENTS

Figure 1:
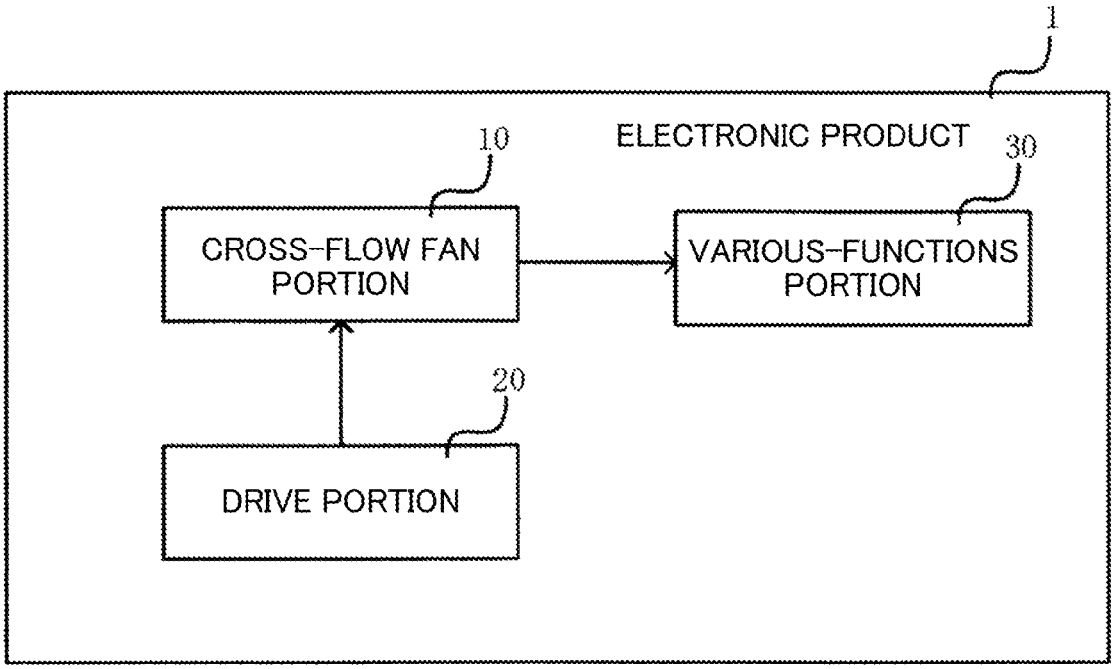
FIG. 1 is a diagram illustrating an outline of an electronic product including a cross-flow fan according to a present embodiment.

FIG. 1 is a diagram illustrating an outline of an electronic product 1 including a cross-flow fan according to the present embodiment. The electronic product 1 is a device including a cross-flow fan, such as an air conditioner and an image forming apparatus. As illustrated in FIG. 1, the electronic product 1 includes a cross-flow fan portion 10, a drive portion 20 configured to rotationally drive the cross-flow fan portion 10, and a various-functions portion 30.

Figure 2:
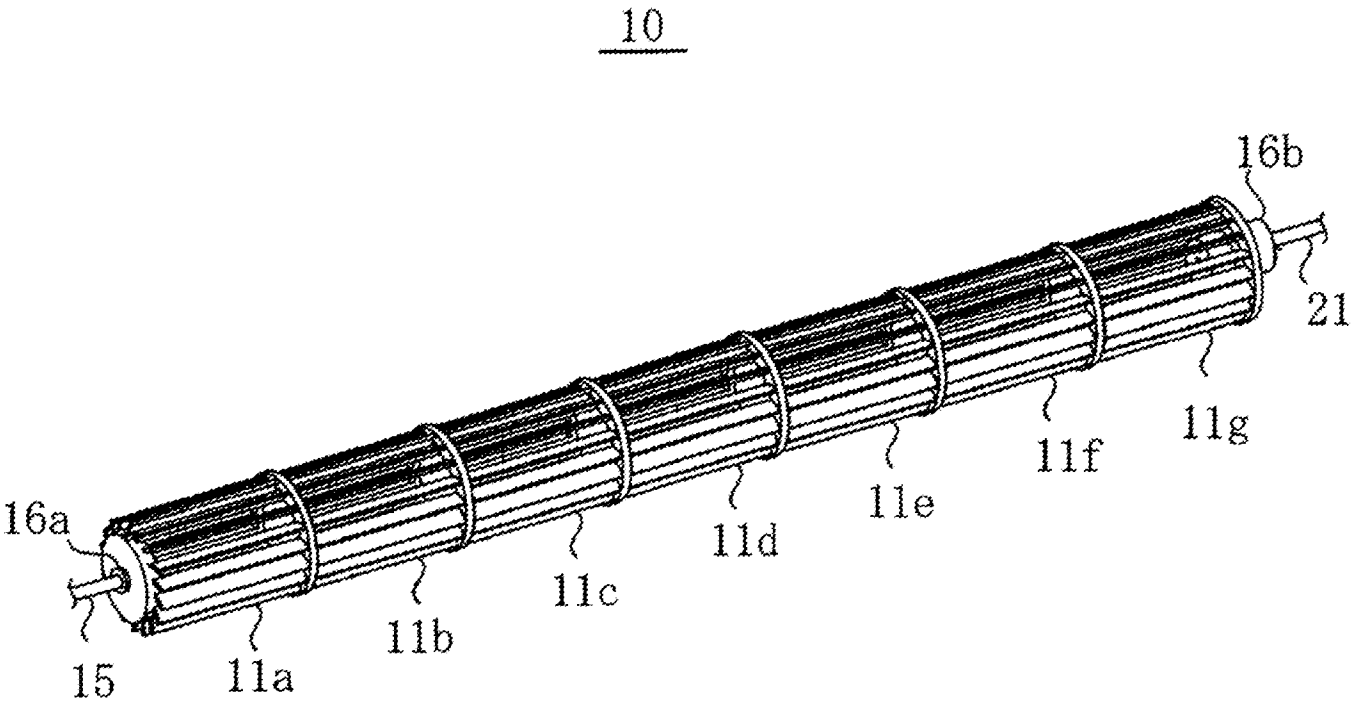
FIG. 2 is a view illustrating an appearance of a cross-flow fan portion according to the present embodiment.

FIG. 2 is a view illustrating an appearance of the cross-flow fan portion 10. The cross-flow fan portion 10 is an airflow generating device used for the purpose of providing blast or internal cooling, for example, and includes a plurality of impellers 11*a* to 11*g*, a shaft 15, and restraint portions 16*a* to 16*b* as illustrated in FIG. 2.

The impellers 11*a* to 11*g* are connected in the direction of a rotation axis. The number of impellers to be connected is preferably set, as appropriate, according to usage or specification of the electronic product 1, such as, for example, having a length suitable for a width of an air blowing opening if the electronic product 1 is an air conditioner. The number of impellers to be connected is also preferably set, as appropriate, according to usage or specification of the electronic product 1, such as having a length suitable for a blowing range in a main scanning direction if the electronic product 1 is an image forming apparatus.

The shaft 15 is disposed at a position of the rotation axis of the plurality of connected impellers 11*a* to 11*g*. The restraint portions 16*a* to 16*b* restrain the movement of each impeller in the direction of the rotation axis relative to the shaft 15 at both ends of the plurality of connected impellers 11*a* to 11*g* in the direction of the rotation axis. More specifically, the restraint portion 16*a* fixes the impeller 11*a* and the shaft 15, and the restraint portion 16*b* fixes the impeller 11*g* and the shaft 15. Further, the restraint portion 16*b* is fixed to a drive shaft 21 included in the drive portion 20. With the cross-flow fan configured by connecting the plurality of impellers in the direction of the rotation axis as described above, a cross-flow fan in which an assembling process of the impellers is simplified can be provided, whereby the man-hours for assembly can be reduced, compared to a conventional cross-flow fan.

Figure 3:
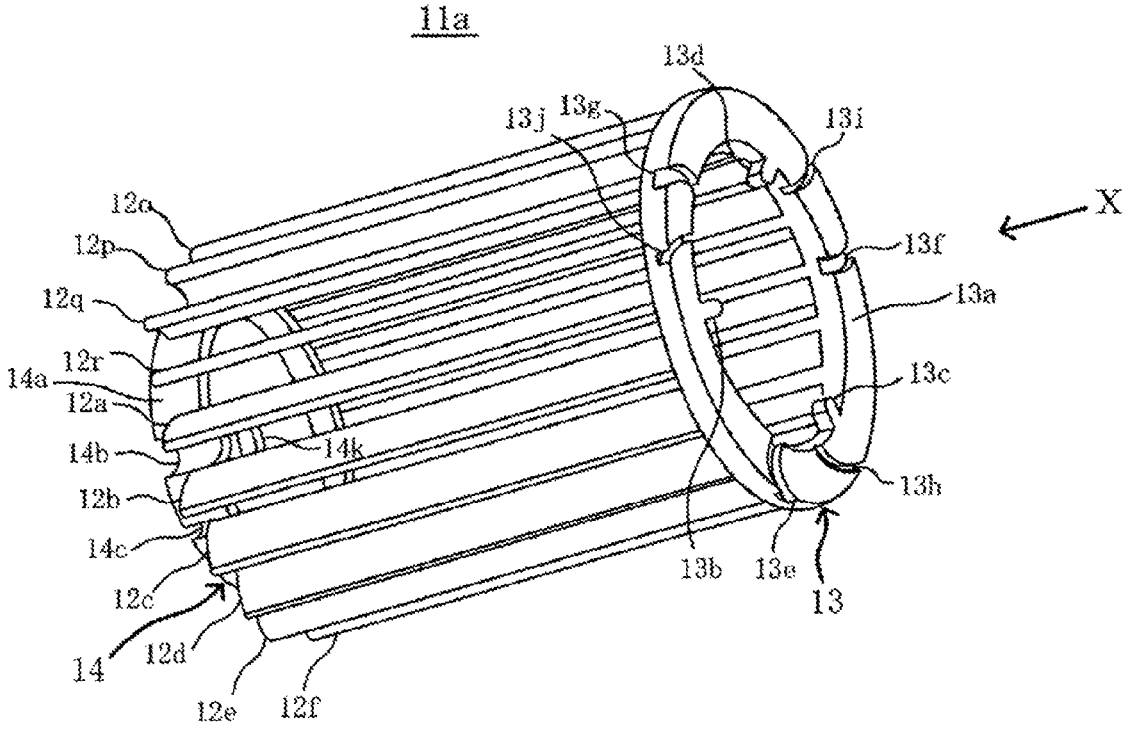
FIG. 3 is a view illustrating an appearance of an impeller according to the present embodiment.
Figure 4:
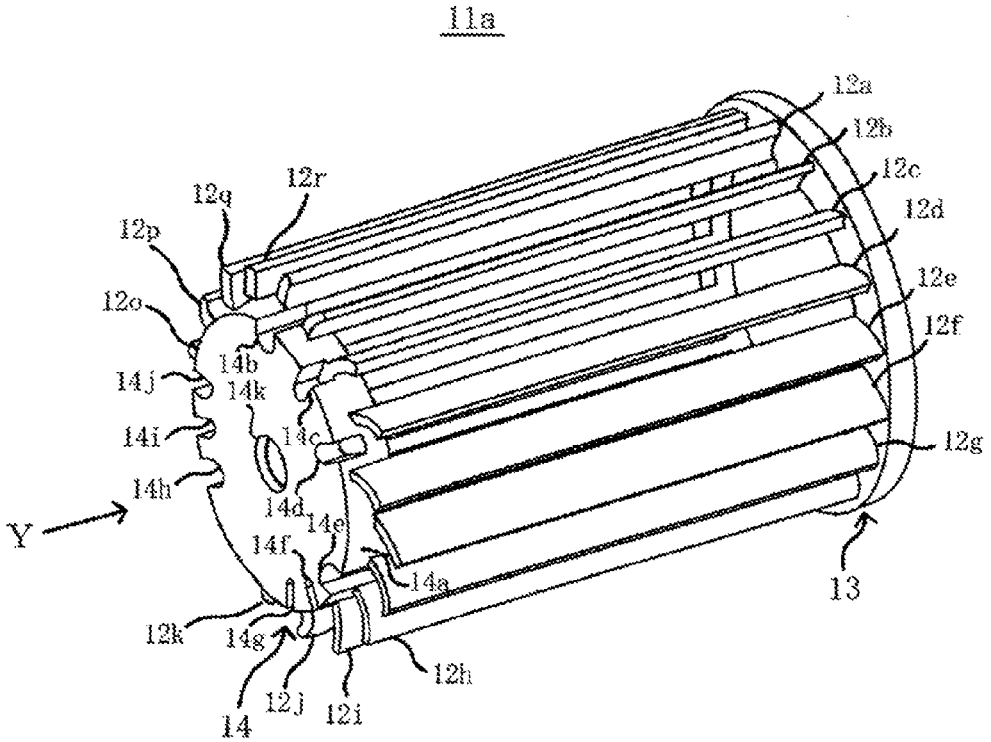
FIG. 4 is a view illustrating an appearance of the impeller according to the present embodiment.
Figure 5:
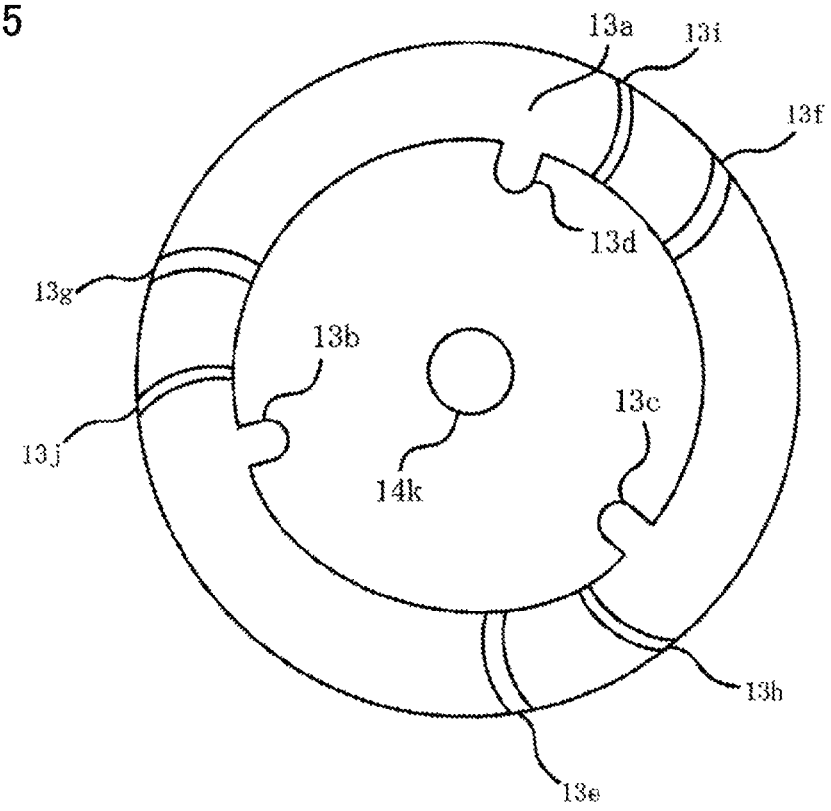
FIG. 5 is a view illustrating the impeller according to the present embodiment as seen from the direction of an arrow X in FIG. 3.
Figure 6:
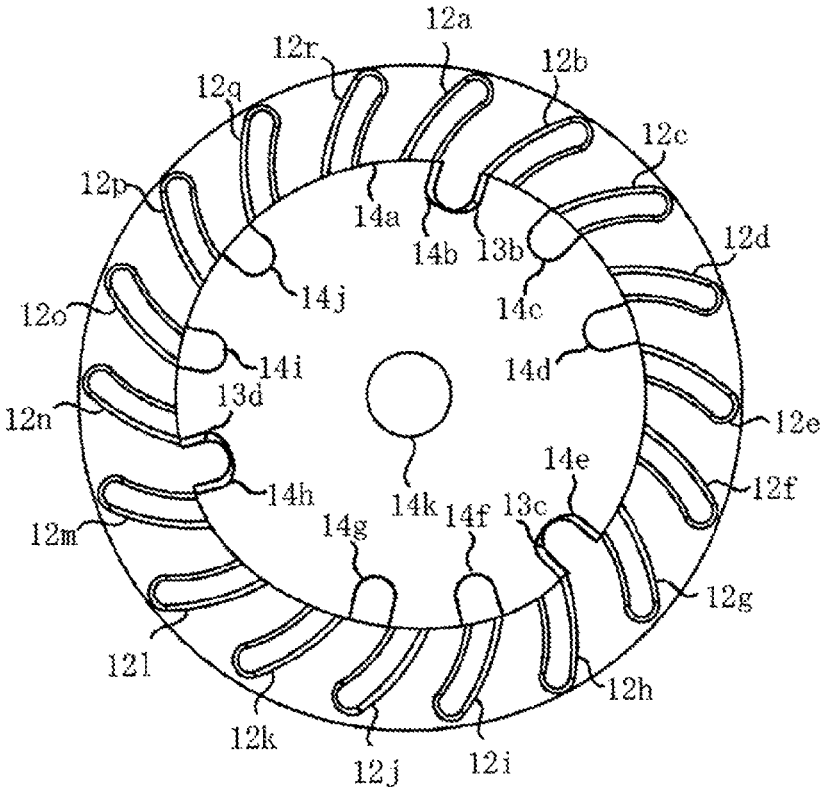
FIG. 6 is a view illustrating the impeller according to the present embodiment as seen from the direction of an arrow Y in FIG. 4.

FIGS. 3 and 4 are views illustrating the appearance of the impeller 11*a*. FIG. 5 is a view of the impeller 11*a* as seen from the direction of an arrow X in FIG. 3. FIG. 6 is a view of the impeller 11*a* as seen from the direction of an arrow Y in FIG. 3. Here, since the impellers 11*b* to 11*g* have the same shape as the impeller 11*a*, their description will be omitted.

The impeller 11*a* includes a plurality of blades 12*a* to 12*r*, a first connection portion 13, and a second connection portion 14, and these components are integrally formed from a resin material. The plurality of blades 12*a* to 12*r* has a function of generating an air flow when being rotationally driven about the rotation axis.

The first connection portion 13 has one or more projections. As illustrated in FIGS. 3 to 6, the first connection portion 13 according to the present embodiment includes a plate-like circular ring 13*a* that fixes one ends of the plurality of blades 12*a* to 12*r* (for example, the right end in FIG. 3), and has three projections 13*b* to 13*d* at the inner circumference of the circular ring 13*a*.

The second connection portion 14 has concavities in a larger quantity than the projections. As illustrated in FIGS. 3 to 6, the second connection portion 14 according to the present embodiment has: an outer circumference 14*a* that fixes the plurality of blades 12*a* to 12*r* at the vicinity of the other ends thereof at the side of the rotation axis (for example, the left side in FIG. 4) and is fitted to the inner circumference of the circular ring 13*a*; nine concavities 14*b* to 14*j* which are formed on the outer circumference 14*a* and fitted to the three projections 13*b* to 13*d* in three ways; and an opening 14*k* which is formed at a position corresponding to the shaft center of the impeller 11*a* and through which the shaft 15 is inserted. Here, the number of the concavities is three times the number of the projections. The number of the concavities is preferably N (N is an integer not smaller than two) times the number of the projections. With this, the first connection portion 13 of one impeller can be connected to the second connection portion 14 of another impeller in N ways.

With the configuration in which the projections of one impeller (for example, the impeller 11*a*) and one part of the concavities of the other impeller (for example, the impeller 11*b*) are fitted to each other in N (N is an integer not smaller than two) ways of having a matched rotation axis, the first connection portion 13 of the one impeller can be connected to the second connection portion 14 of the other impeller.

In the present embodiment, a first fitted state to a third fitted state described below can be selected according to usage or specification of an electronic product to be used. Specifically, in the first fitted state, the projection 13*b* of one impeller and the concavity 14*b* of another impeller are fitted to each other, the projection 13*c* of the one impeller and the concavity 14*e* of the other impeller are fitted to each other, and the projection 13*d* of the one impeller and the concavity 14*h* of the other impeller are fitted to each other.

Figure 7:
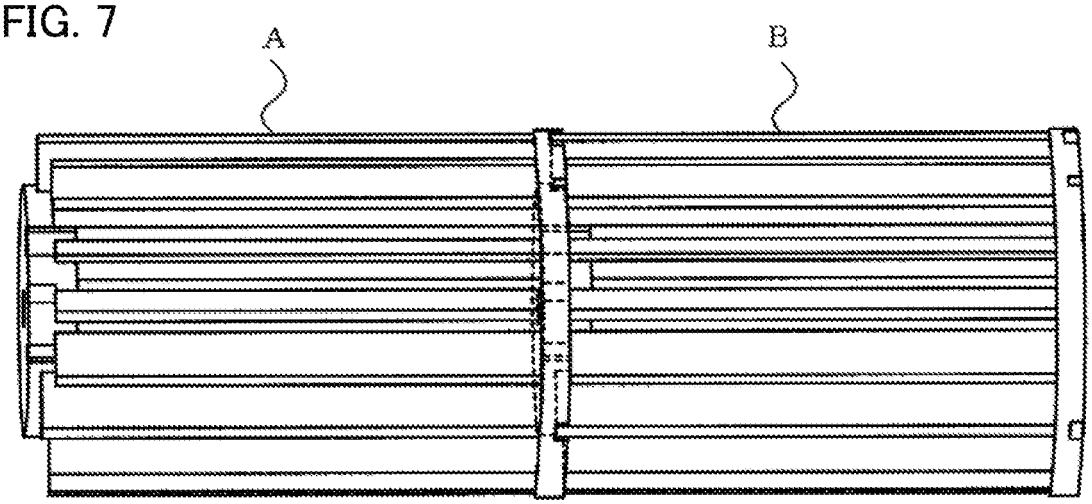
FIG. 7 is a view illustrating the impeller in a first fitted state according to the present embodiment.

FIG. 7 is a view illustrating the impeller in the first fitted state. In the first fitted state illustrated in FIG. 7, the concavities 14*b*, 14*e*, and 14*h* (hereinafter referred to as "first concavity") of the one impeller (impeller A in FIG. 7) are fitted to the projections 13*b* to 13*d* of the other impeller (impeller B in FIG. 7) with a state in which the phase of blades of the one impeller and the phase of blades of the other impeller are identical. When the impellers 11*a* to 11*g* are connected to one another with the state in which blades of these impellers have the same phase, a cross-flow fan that can create uniform and wide wind suitable for cooling can be provided. A cross-flow fan suitable for a place requiring reduction in noise, such as a library, can be provided due to enhanced noise reducing effect.

In the impeller in the second fitted state, the projection 13*b* of one impeller and the concavity 14*c* of another impeller are fitted to each other, the projection 13*c* of the one impeller and the concavity 14*f* of the other impeller are fitted to each other, and the projection 13*d* of the one impeller and the concavity 14*i* of the other impeller are fitted to each other.

Figure 8:
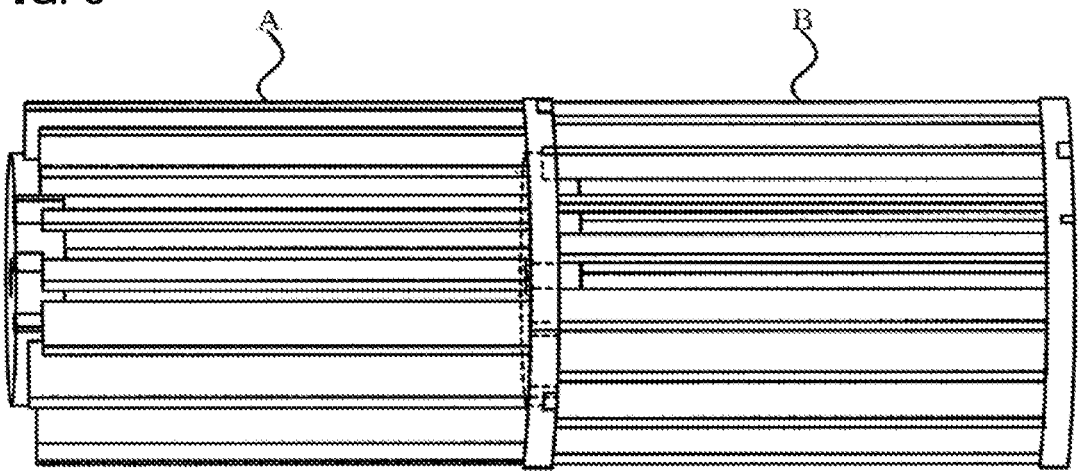
FIG. 8 is a view illustrating the impeller in a second fitted state according to the present embodiment.

FIG. 8 is a view illustrating the impeller in the second fitted state. In the second fitted state illustrated in FIG. 8, the concavities 14*c*, 14*f*, and 14*i* (hereinafter referred to as "second concavity") of the one impeller (impeller A in FIG. 8) are fitted to the projections 13*b* to 13*d* of the other impeller (impeller B in FIG. 8) in a state in which the phase of blades of the one impeller and the phase of blades of the other impeller are shifted from each other. When the impellers 11*a* to 11*g* are connected to one another in the state in which the phases are shifted from each other, a cross-flow fan suitable for a place requiring reduction in noise, such as a library, and having high noise reducing effect can be provided.

It should be noted that, preferably, the first concavity is formed wider than the second concavity in the rotating direction in order that the second concavity is fitted to the projections 13*b* to 13*d* without looseness and the first concavity is fitted to the projections 13*b* to 13*d* with looseness. In the case where the impellers 11*a* to 11*g* are fitted without looseness, a cross-flow fan that can create uniform and wide wind suitable for cooling can be provided. On the other hand, in the case where the impellers 11*a* to 11*g* are fitted with looseness, a cross-flow fan that can create turbulence suitable for blowing off steam in a fixing device can be provided.

In the impeller in the third fitted state, the projection 13*b* of one impeller and the concavity 14*d* of another impeller are fitted to each other, the projection 13*c* of the one impeller and the concavity 14*g* of the other impeller are fitted to each other, and the projection 13*d* of the one impeller and the concavity 14*j* of the other impeller are fitted to each other.

Figure 9:
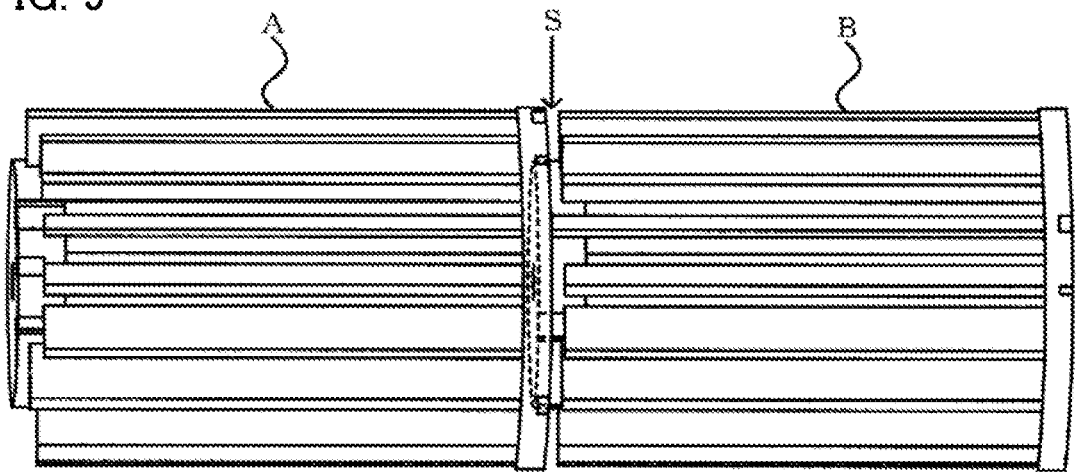
FIG. 9 is a view illustrating the impeller in a third fitted state according to the present embodiment.

FIG. 9 is a view illustrating the impeller in the third fitted state. The plurality of blades 12*a* to 12*r* preferably includes a normal-length blade and a long blade longer than the normal-length blade at the side of the second connection portion 14, and a recess into which the long blade of other impeller at the side of the second connection portion 14 is embedded in some fitted states is formed on the first connection portion 13 of one impeller, when the first connection portion 13 of the one impeller and the second connection portion 14 of the other impeller are connected to each other. Specifically, as illustrated in FIGS. 3 and 5, the blades 12*e*, 12*k*, and 12*q* are each formed into the long blade, and the other blades are each formed into the normal-length blade. In addition, first recesses 13*e* to 13*g*, into which the long blades are embedded at the side of the second connection portion 14 in the first fitted state, and second recesses 13*h* to 13*j*, into which the long blades are embedded at the side of the second connection portion 14 in the second fitted state, are formed on the circular ring 13*a* of the first connection portion 13. Further, recesses into which the long blades are embedded at the side of the second connection portion 14 in the third fitted state are not formed.

With this, in the third fitted state illustrated in FIG. 9, the concavities 14*d*, 14*g*, and 14*j* of one impeller (impeller A in FIG. 9) are fitted to the projections 13*b* to 13*d* of another impeller (impeller B in FIG. 9) in a state in which a gap (an arrow S in FIG. 9) is formed between normal-length blades of the one impeller and normal-length blades of the other impeller. When the long blades of the impellers 11*a* to 11*g* are embedded, a cross-flow fan that can create uniform and wide wind suitable for cooling can be provided. On the other hand, when a part of the long blades of the impellers 11*a* to 11*g* is not embedded, a gap is formed between normal-length blades of one impeller and normal-length blades of another impeller, and thus, a cross-flow fan that can create turbulence suitable for blowing off steam in a fixing device can be provided.

The drive portion 20 includes a power source, such as a motor, for rotationally driving the cross-flow fan portion 10, and a transmission mechanism that transmits power, such as a gear (not illustrated), a belt (not illustrated), and the drive shaft 21 (illustrated in FIG. 2).

The various-functions portion 30 is an element configured to control functions specific to the electronic product 1, such as temperature control in an air conditioner, or printing, scanning, and copying in an image forming apparatus, and a combination thereof.

In the present embodiment, the projections 13*b* to 13*d* are formed on the inner circumference of the circular ring 13*a* of the first connection portion 13, and the concavities 14*b* to 14*j* are formed on the outer circumference 14*a* of the second connection portion 14. On the contrary, the projections may be formed on the outer circumference 14*a* of the second connection portion 14, and the concavities may be formed on the inner circumference of the circular ring 13*a* of the first connection portion 13.

In the present embodiment, the projections and the concavities are formed in the radial direction (the direction toward the rotation axis). However, the projections and the concavities may be formed in the direction parallel to the rotation axis, for example. That is, the projections may project in the direction parallel to the rotation axis, and the concavities may be recessed in the direction parallel to the rotation axis. Alternatively, the projections and the concavities may be formed in the radial direction and the direction parallel to the rotation axis, respectively. Alternatively, with respect to the projections and the concavities, the long blade longer than the normal-length blade may be used as the projections, and the recess may be used as the concavities.

As described above, in the cross-flow fan portion 10 having the above configuration, in a connection between the first connection portion 13 of one impeller and the second connection portion 14 of another impeller, the projections of the one impeller and one part of the concavities of the other impeller are fitted to each other in one fitted state among N (N is an integer not smaller than two) ways of fitted states of having a matched rotation axis. With this configuration, a cross-flow fan of various types can be provided using impellers having the same shape without preparing a special die according to usage or specification of an electronic product. Accordingly, production cost can be reduced.

INDUSTRIAL APPLICABILITY

The present invention can widely be applied to an electronic product including a cross-flow fan, such as an air conditioner or an image forming apparatus. With the present invention, production cost of a cross-flow fan can be reduced, and thus, the industrial utility value thereof is significantly high.

The invention claimed is:

1. A cross-flow fan comprising a plurality of impellers connected in a direction of a rotation axis, each of the impellers including:

a plurality of blades;

a first connection portion having at least one projection; and a second connection portion having concavities in a larger quantity than the projection, wherein, in a connection between the first connection portion of one of the impellers and the second connection portion of another one of the impellers, the projection of the one of the impellers and one part of the concavities of the another one of the impellers are fitted to each other in one fitted state among N (N is an integer not smaller than two) ways of fitted states of having a matched rotation axis.

2. The cross-flow fan according to claim 1, wherein the concavities include:

a first concavity fitted to the projection in a state in which phase of blades of the one of the impellers and phase of blades of the another one of the impellers are identical; and a second concavity fitted to the projection in a state in which phase of blades of the one of the impellers and phase of blades of the another one of the impellers are shifted from each other.

3. The cross-flow fan according to claim 2, wherein the first concavity is wider than the second concavity in a rotation direction, the second concavity is fitted to the projection without looseness, and the first concavity is fitted to the projection with looseness.

4. The cross-flow fan according to claim 1, wherein the first connection portion includes a plate-like circular ring that fixes one ends of the plurality of blades, the projection is located on an inner circumference of the circular ring, the second connection portion has an outer circumference that fixes the plurality of blades at the vicinity of other ends thereof at the side of the rotation axis and is fitted to the inner circumference of the circular ring, the concavities are located on the outer circumference, the plurality of blades includes a normal-length blade and a long blade longer than the normal-length blade at the side of the second connection portion, and the first connection portion has a recess into which a part of the long blade of the another one of the impellers is embedded in some of the fitted states, when being connected to the second connection portion of the another one of the impellers.

5. The cross-flow fan according to claim 1, wherein a total number of the concavities is N times of a total number of the projection.

6. The cross-flow fan according to claim 1, further comprising:

a shaft disposed at a position of the rotation axis of the plurality of connected impellers; and a restraint portion configured to restrain movement of each of the impellers in the direction of the rotation axis with respect to the shaft.

7. An electronic product comprising:

the cross-flow fan according to claim 1; and a drive portion configured to rotationally drive the cross-flow fan.

8. An impeller used for a cross-flow fan including a plurality of the impellers connected in a direction of a rotation axis, the impeller comprising:

a plurality of blades;

a first connection portion having at least one projection; and a second connection portion having concavities in a larger quantity than the projection, wherein the projection of one of the impellers and one part of the concavities of another one of the impellers are fitted to each other in N (N is an integer not smaller than two) ways of having a matched rotation axis, to connect the first connection portion of the one of the impellers and the second connection portion of the another one of the impellers.

* * * * *